US007204863B2

(12) United States Patent
Kelemen et al.

(10) Patent No.: US 7,204,863 B2
(45) Date of Patent: Apr. 17, 2007

(54) GASOLINE ADDITIVES FOR REDUCING THE AMOUNT OF INTERNAL COMBUSTION ENGINE INTAKE VALVE DEPOSITS AND COMBUSTION CHAMBER DEPOSITS

(75) Inventors: Simon Robert Kelemen, Annandale, NJ (US); Michael Siskin, Randolph, NJ (US); Kenneth Dale Rose, Media, PA (US); Harald Schwahn, Wiesloch (DE); Marco Bergemann, Hockenheim (DE); Michael Ehle, Ludwigshafen (DE); Peter Schreyer, Weinheim (DE)

(73) Assignee: ExxonMobil Research and Engineering Company, Annandale, NJ (US)

( * ) Notice: Subject to any disclaimer, the term of this patent is extended or adjusted under 35 U.S.C. 154(b) by 367 days.

(21) Appl. No.: 10/299,453

(22) Filed: Nov. 19, 2002

(65) Prior Publication Data

US 2003/0145512 A1 Aug. 7, 2003

Related U.S. Application Data

(60) Provisional application No. 60/339,434, filed on Dec. 11, 2001.

(51) Int. Cl.

| | |
|---|---|
| ***C10L 1/18*** | (2006.01) |
| ***C10L 1/182*** | (2006.01) |
| ***C10L 1/222*** | (2006.01) |
| ***C10L 1/224*** | (2006.01) |
| ***C10L 1/232*** | (2006.01) |

(52) U.S. Cl. ..... 44/340; 44/412; 44/443; 44/418

(58) Field of Classification Search ..... 44/340, 44/412, 443, 418

See application file for complete search history.

(56) References Cited

U.S. PATENT DOCUMENTS

| | | | | |
|---|---|---|---|---|
| 3,337,585 | A | 8/1967 | Swakon et al. | 260/326.5 |
| 4,478,604 | A | 10/1984 | Schuettenberg | 44/63 |
| 4,747,851 | A | 5/1988 | Sung et al. | 44/72 |
| 4,832,702 | A * | 5/1989 | Kummer et al. | 44/412 |
| 4,844,714 | A | 7/1989 | Vogel et al. | 44/63 |
| 5,004,478 | A | 4/1991 | Vogel et al. | 44/398 |
| 5,112,364 | A | 5/1992 | Rath et al. | 44/418 |
| 5,660,601 | A | 8/1997 | Oppenlander et al. | 44/433 |
| 6,133,209 | A | 10/2000 | Rath et al. | 508/448 |
| 6,261,327 | B1 * | 7/2001 | Graham et al. | 44/338 |
| 6,267,791 | B1 | 7/2001 | Thomas et al. | 44/412 |
| 2002/0023383 | A1 | 2/2002 | Nelson et al. | 44/451 |

FOREIGN PATENT DOCUMENTS

| | | |
|---|---|---|
| DE | 19616270 | 11/1997 |
| DE | 19618270 A | 11/1997 |

(Continued)

*Primary Examiner*—Cephia D. Toomer
(74) *Attorney, Agent, or Firm*—Joseph J. Allocca

(57) ABSTRACT

Compositions and methods are disclosed for reducing combustion chamber deposits (CCD) and/or intake valve deposits (IVD) in spark ignition internal combustion engines. A butyrolactam alkoxylate (BLA) and/or a butyrolactam derivative (BLD) of this invention or a mixture with at least one additional compound of this invention is added to a liquid hydrocarbon or liquid hydrocarbon-oxygenate gasoline each in an amount of about 0.0005-0.5 wt % of the gasoline. Preferably the gasoline is unleaded. The preferred additional components include polyethers (PE) and polyisobutylene amine (PIBA).

11 Claims, 2 Drawing Sheets

FOREIGN PATENT DOCUMENTS

| | | | |
|---|---|---|---|
| DE | 19618270 | A1 | 11/1997 |
| EP | 0310875 | A1 | 4/1989 |
| EP | 0487255 | A | 5/1992 |
| EP | 0565285 | | 10/1993 |
| EP | 0878532 | A | 11/1998 |
| EP | 0704519 | B1 | 5/1999 |
| WO | WO9422984 | A | 10/1994 |
| WO | WO9736971 | A | 10/1997 |
| WO | WO9830658 | A | 7/1998 |
| WO | WO00/02978 | | 1/2000 |
| WO | WO0185874 | A | 11/2001 |

* cited by examiner

GASOLINE ADDITIVES FOR REDUCING THE AMOUNT OF INTERNAL COMBUSTION ENGINE INTAKE VALVE DEPOSITS AND COMBUSTION CHAMBER DEPOSITS

This application claims the benefit of U.S. Provisional Application No. 60/339,434 filed on Dec. 11, 2001.

FIELD OF THE INVENTION

The invention relates to a method for reducing combustion chamber deposits (CCD), intake valve deposits (IVD) or both in spark ignition internal combustion engines which utilize unleaded liquid hydrocarbon or liquid hydrocarbon/oxygenated gasolines, said method involving the addition of additives to the gasoline to be burned.

BACKGROUND OF THE INVENTION

The control of intake valve deposits (IVD), combustion chamber deposits (CCD), and the octane requirement increase (ORI) attributable to CCD has long been a subject of concern to engine and vehicle manufacturers, fuel processors and the public and is extensively addressed in the literature. Solutions to this problem and related problems of knock, have taken the form of novel gasoline additives such as detergents, anti-corrosives, octane requirement reducing additives, deposit control additives and numerous combinations of additives. Other approaches modify intake valve and combustion chamber configurations.

Traditional IVD control additives are based on the use of detergents such as polyisobutylene amine (PIBA) and polyether amines (PEA). These detergents effectively disperse and solubilize the growing carbonaceous deposit and operate efficiently when there is ample washing of the intake valve by gasoline gasoline containing one of these detergents. However, these additives contribute to CCD. The combination of alkoxylates with PIBA and PEA facilitates their controlled decomposition along with the simultaneous decomposition of deposit precursors on combustion chamber walls.

Gasoline detergents are now required in the United States for controlling deposit formation on auto engine intake valves. There is current interest in developing new detergent-based additive packages that can simultaneously and optimally control both IVD and CCD. Thus, a reasonably priced additive with greater reduction of IVD and CCD is desirable.

SUMMARY OF THE INVENTION

Figure 1:
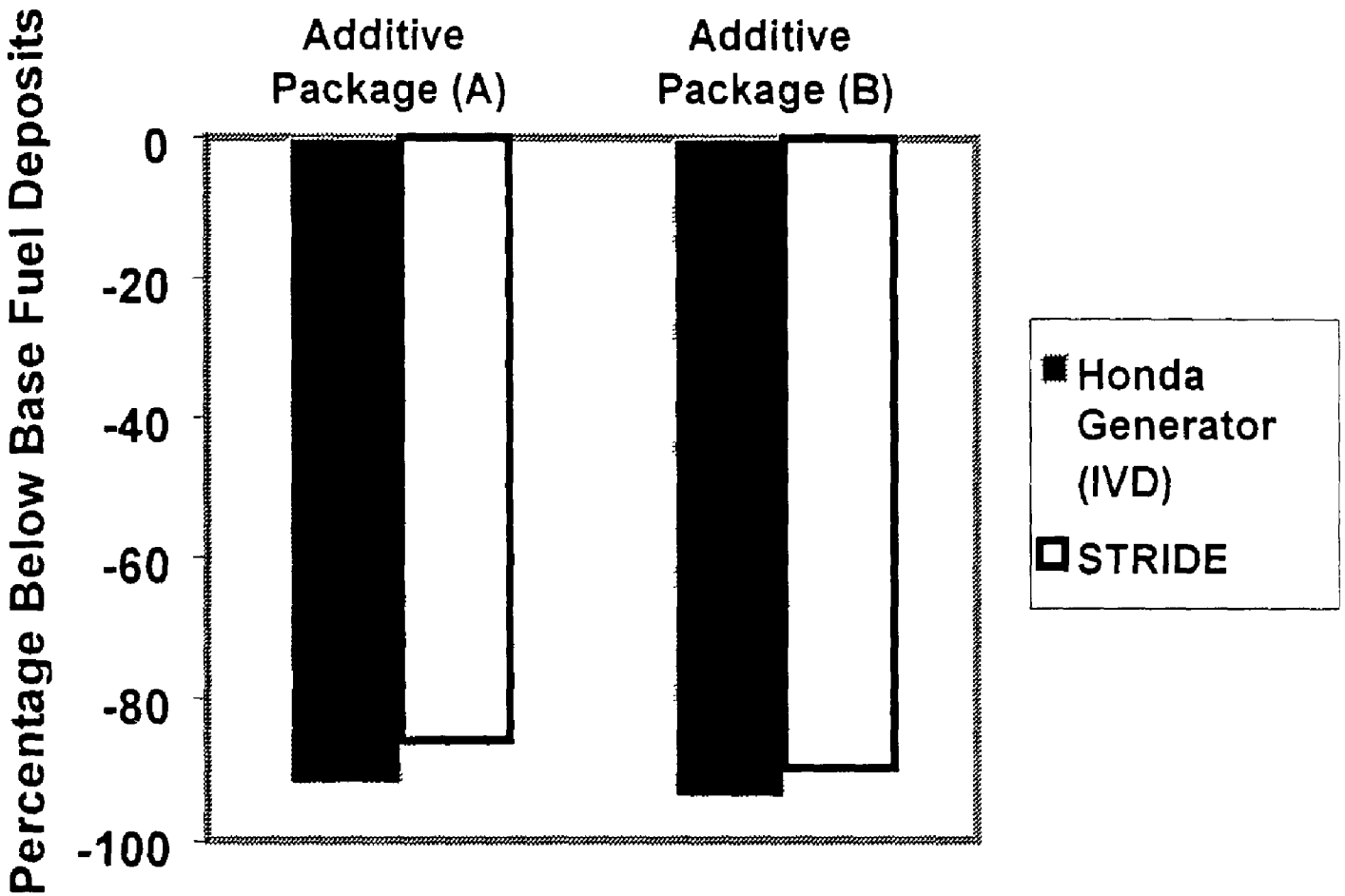
FIG. 1 presents a comparison of the results secured using the STRIDE test and the results from an engine test using gasolines containing 2 different commercial additive packages (A) and (B). The STRIDE procedure successfully emulates the IVD results from a Honda ES 6500 generator test.

Broadly stated, this invention relates to compositions and method for decreasing combustion chamber deposits (CCD), intake valve deposits (IVD) or both simultaneously in spark ignition internal combustion engines run on unleaded gasoline, the base of which typically comprising liquid hydrocarbon and mixed unleaded liquid hydrocarbon/oxygenate fuels by incorporating into the base fuel an effective amount of at least one compound selected from butyrolactam alkoxylate (BLA) or butyrolactam derivatives (BLD) gasoline additives represented by formulas (A) and (B) wherein n is an integer from 9 to 35 inclusive; e, f, and g independently are an integer from 0 to 50 inclusive, wherein at least one of e, f, and g is not 0; $R^5$ and $R^{5'}$ are independently selected from the group consisting of H, $CH_3$, and $CH_2CH_3$; $R^6$ is H or $C_1$–$C_{20}$ alkyl; and wherein $R^1$, $R^2$, $R^3$, and $R^4$ are independently selected from the group consisting of H, and $C_1$–$C_{100}$ alkyl, or taken together with the two carbons between $R^1$ and $R^2$, or $R^3$ and $R^4$ form an aliphatic ring of 5–8 carbon atoms; and mixtures thereof.

Compound A

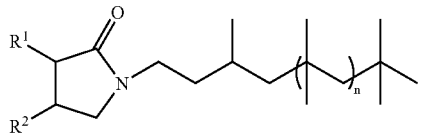

(a BLD)

Compound B

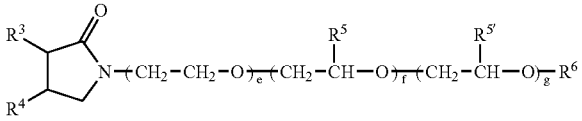

(a BLA)

In a second aspect we have also discovered a synergistic effect; that mixtures of BLA with polyether (PE) and PE/polyisobutylene amine (PIBA) lower the level of bench test IVD deposits and bench test CCD deposits. This synergistic effect is in contrast to results which show that PIBA increases the level of bench CCD deposits.

DESCRIPTION OF THE INVENTION

According to the invention, butyrolactam alkoxylate (BLA) of formula (B) and mixtures of formula B with compounds (A), and (C) to (K) generally reduce the level of deposits produced in bench prescreening tests for auto engine intake valve deposits (IVD) [e.g., see STRIDE test] and/or combustion chamber deposits (CCD) [e.g., see TORID test]. Gasolines with BLD additives of formula (A) give higher TORID values than gasoline without BLD. We have discovered that our compositions (e.g., BLA+PIBA) lower the level of bench test IVD deposits without increasing the level of bench test CCD deposits, even though each alone gives a higher or equivalent level of bench CCD deposits.

We have found that mixtures of BLA (Formula (B)), with at least one of polyethers (PE) and polyisobutylene amine (PIBA) generally lower the level of bench test IVD deposits (Table 4) and generally improves (above) the level of bench test CCD deposits (Table 5). Table 3's TORID values show that gasolines with mixtures of these additives have lower CCD values than the gasoline alone and gasoline with PIBA alone. This is in contrast to results which show that PIBA and similar compounds in the absence of the polymeric butyrolactam alkoxylates increase the level of bench CCD deposits.

We have also found that mixtures of BLD with alkoxylates and/or PIBA generally lower the level of bench test IVD deposits and generally improves (above) the level of bench test CCD deposits.

Preferred compounds (Cmpd.) and mixtures of compounds (e.g., Cmpd. A & D) of this invention are shown below.

In the following compounds, the preferred variables are:

n is an integer from 9 to 35 inclusive (preferably 20–35)

$R^1$, $R^2$, $R^3$, and $R^4$ are independently selected from the group consisting of H, and $C_1$–$C_{100}$ alkyl, or taken together with the two carbons between $R^1$ and $R^2$, or $R^3$ and $R^4$ form an aliphatic ring of 5–8 carbon atoms (preferably H and $C_1$–$C_{80}$ alkyl, more preferably H and $C_1$–$C_{10}$ alkyl, most preferably H and $C_1$–$C_3$ alkyl), e, f and g are integers from 0 to 50 inclusive (preferably 1–35, more preferably 20–35) wherein at least on of e, f and g are not 0, $R^5$ and $R^{5'}$ are independently selected from the group consisting of H, $CH_3$, and $CH_2CH_3$, y is an integer from 1–50 inclusive (preferably 1–35, more preferably 20–35), m is an integer from 2–6 inclusive, $R^6$ is H or $C_1$–$C_{20}$ alkyl, and $R^7$ is $C_1$–$C_{25}$ alkyl or cycloalkyl, preferably $C_1$–$C_4$ linear or branched alkyl.

Alkyl groups may be branched or unbranched. Branched alkyl groups are generally preferred.

Compound A

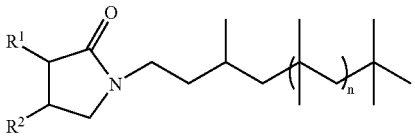

Compound B

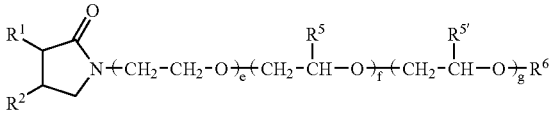

Compound C

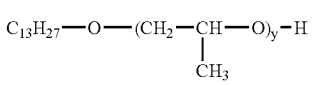

Preferred embodiment:

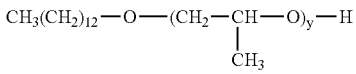

Compound D

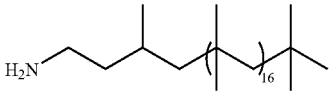

(PIBA)

-continued

Compound E

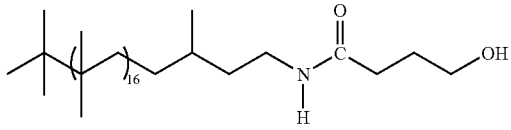

Compound F

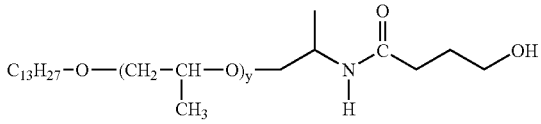

Preferred embodiment:

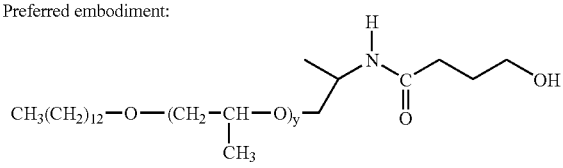

Compound G

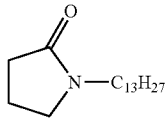

(a BLD)

Preferred embodiment:

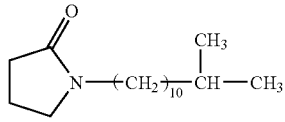

Compound H

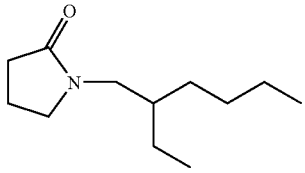

(a BLD)

Compound I

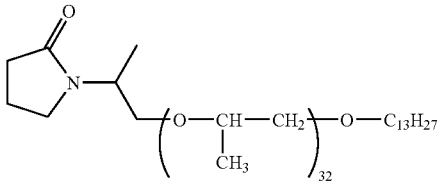

(a BLD/BLA combination)

Preferred embodiment:

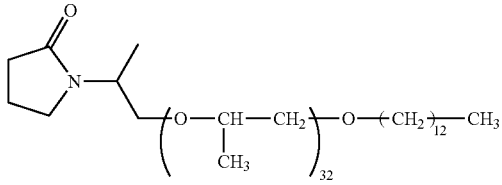

-continued

Compound J

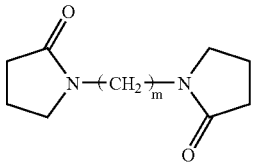

Compound K

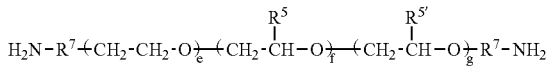

and mixtures thereof.

Compound A can be used alone. Compound B can be used alone. Any combination of compounds A through K, inclusive can be used. Preferred two component mixtures comprise: A & C, A & D, B & C, and B & D. Preferred three component mixtures comprise: A & C & D, and B & C & D. The above compounds alone or in combination can also be mixed with propylene oxide and/or propylene glycol.

These butyrolactam derivatives and mixtures are preferably employed at concentrations of 5–5,000 ppm, preferably 100–2,500 ppm, most preferably 100–1,000 ppm. Additized gasoline mixtures preferably contain 0.0005–0.5 wt % additive in the gasoline with economically maximum levels of 1 wt % additive (and additive by-products) of the gasoline.

The gasolines which may be additized either by blending or by separate injection of the additive directly into the gas tank or into the engine utilizing such gasolines, can be ordinary unleaded gasoline of any grade, containing other, typical gasoline additives ordinarily added to such gasolines, e.g., other detergents, deicing additives, anti-knock additives, corrosion, wear, oxidation, anti-rust, etc., additives known to the art. As is readily apparent and already known in the industry, however, the skilled practitioner will have to ensure compatibility between the additives employed. The gasoline can also be any of the currently fashionable reformulated gasolines, i.e., those containing various oxygenated compounds such as ether (MTBE, ETBE, TAME, etc.) or alcohols (methanol, ethanol) in various concentrations. Preferred base fuels include unleaded gasoline, oxygenated unleaded gasoline, and petroleum hydrocarbons in the gasoline boiling range.

Examples of functionalized polymeric detergents include polyolefinic amines, polyolefinic ether amines, polyolefin oxides, alkyl pyrrolidones and their copolymers with olefins or dienes.

The polymers employed are those which depolymerize at the conditions typically encountered in the engine combustion chamber, i.e., about 400° C. Preferred polyolefin amines include: polybutylene amine, polyisobutylene amine, polypropylene amine (MW 800–2000). Preferred polyetheramines include: polyethylene oxide amines, polypropylene oxide amines, polybutylene oxide amines, polyisobutylene oxide amines, and mixed polyolefinic oxide amines (MW 800–2000).

The additives described above can be added directly to the gasoline or separately injected into the fuel system of the engine. Alternatively, the additives can be added to the lubricating oil and from that environment favorably affect CCD and IVD. The additives can also be encapsulated to overcome any odor, toxicity or corrosivity concerns which may arise with any one or group of additives within the aforesaid recitations.

TABLE 1

| Gasoline Additive | Name | Description |
|---|---|---|
| Cmpd. C | PE | y = 30 |
| Cmpd. D | PIBA | |
| Cmpd. C & D | PIBA + PE | |
| Cmpd. B $_{(1)}$ | BLA | e = 0, f = 33, g = 0, $R^6$ = H (in 33% propylene glycol) |
| Cmpd. B $_{(2)}$ | BLA | e = 0, f = 50, g = 0, $R^6$ = H (in 33% propylene glycol) |
| Cmpd. B $_{(3)}$ | BLA | e = 0, f = 1, g = 0, $R^6$ = H (with polyethylene oxide) |
| Cmpd. B $_{(4)}$ | BLA | e = 0, f = 3, g = 0, $R^6$ = H (with polyethylene oxide) |
| Cmpd. B $_{(5)}$ | BLA | e = 0, f = 5, g = 0, $R^6$ = H (with polyethylene oxide) |
| Cmpd. B $_{(6)}$ | BLA | e = 0, f = 7, g = 0, $R^6$ = H (with polyethylene oxide) |
| Cmpd. B $_{(7)}$ | BLA | e = 0, f = 9, g = 0, $R^6$ = H |
| Cmpd. B $_{(8)}$ | BLA | e = 0, f = 33, g = 0, $R^6$ = H |
| Cmpd. B $_{(9)}$ | BLA | e = 0, f = 50, g = 0, $R^6$ = H |
| Cmpd. B $_{(10)}$ | BLA | e = 1, f = 0, g = 20, $R^6$ = H |
| Cmpd. B $_{(11)}$ | BLA | e = 0, f = 3, g = 0, $R^6$ = H (with polyethylene oxide) |
| Cmpd. B $_{(4)}$ & C & D | BLA + PE + PIBA | y = 30, e = 0, f = 3, g = 0, $R^6$ = H (with polyethylene oxide) |
| Cmpd. B $_{(5)}$ & C & D | BLA + PE + PIBA | y = 30, e = 0, f = 5, g = 0, $R^6$ = H (with polyethylene oxide) |
| Cmpd. B $_{(11)}$ & C & D | BLA + PE + PIBA | y = 30, e = 0, f = 9, g = 0, $R^6$ = H (with polyethylene oxide) |
| Cmpd. B $_{(9)}$ & C & D | BLA + PE + PIBA | y = 30, e = 1, f = 0, g = 20, $R^6$ = H |
| Cmpd. B $_{(9)}$ & D | BLA + PIBA | y = 30, e = 1, f = 0, g = 20, $R^6$ = H |
| Cmpd. B $_{(4)}$ & D | BLA + PIBA | y = 30, e = 0, f = 3, g = 0, $R^6$ = H (with polyethylene oxide) |
| Cmpd. B $_{(5)}$ & D | BLA + PIBA | y = 30, e = 0, f = 5, g = 0, $R^6$ = H (with polyethylene oxide) |
| Cmpd. B $_{(6)}$ & D | BLA + PIBA | y = 30, e = 0, f = 9, g = 0, $R^6$ = H (with polyethylene oxide) |
| Cmpd. C & E | | y = 30 |
| Cmpd. A & C | | n = 16, y = 30 |
| Cmpd. C & F | | y = 32 (with 33% polyethylene oxide) |
| Cmpd. C & K | | |

The compounds and mixtures shown in Table 1, as added to the gasoline, are the preferred embodiments of this invention. Because the additives are usually not 100% pure, mixtures of these compounds with smaller amounts of reaction products, contaminants, enantiomers, degradation products, and similar compounds are considered to be part of this invention.

Not only are monomers rarely pure, but polymerization almost never produces perfect polymers. This invention includes polymers based on the listed monomers, but incorporating a minority of polymer chain units that differ from the ideal units shown in the specification. For example, different atoms of the monomer can sometimes be used as polymer linkages. Also, reaction products, contaminants, enantiomers, degradation products, and monomer by-products can be incorporated into the polymer.

Tables 2 and 4 contain data on the performance of the above additives in the STRIDE test. This is a bench test for intake valve deposits. The IVD bench test apparatus (called STRIDE) has been disclosed in U.S. Pat. NO. 5,492,005, which is incorporated by reference.

Surrogate Test Related to Intake Deposit Evaluation (STRIDE) is a laboratory apparatus that can be used to study the effects of fuel composition, additives, and transport on intake valve deposit (IVD) formation. The apparatus uses a syringe pump to slowly deliver fuel to the horizontal end face of a small cylindrical nub where the deposit is formed and weighed. Unlike other surrogate tests the cyclic temperature of intake valves in engines is simulated by cycling the nub temperature.

In the STRIDE test, deposits are formed on the end face of a metal nub. The nub is small (6.35 mm diameter by 17.5 mm long). The shape of the nub face is a concave shallow cone. Compared with flat or convex shapes the concave shape increases the amount of gasoline retained on the nub face. It also makes the deposit formation less sensitive to slight misalignments of the nub from vertical. Initially nubs were fabricated from 410 stainless steel because of its similarity to BMW 325 engine intake valves, however the amount of STRIDE deposit formed on aluminum and brass nubs was similar to the amount made on steel nubs.

In a STRIDE test the nub is forced inside the coils of a cable heater. A shielded thermocouple is inserted into the hole on the axis of the nub. The thermocouple tip is about 0.5 mm below the nub surface. The nub's small mass, about 3.5 g, makes it possible to cycle its temperature during the STRIDE test by controlling the electric power to the coiled cable heater. To assure that the increase in nub weight is due solely to the deposit, the thermocouple, cable heater, and nub are held together solely by friction. No cement or heat transfer compounds are used.

A bell shaped glass shield surrounds the nub and cable heater. The glass shield prevents turbulence within the fume hood from disturbing the delivery of gasoline and from affecting the nub temperature. It carries a blanketing flow of air that is filtered through molecular sieves and a drier. Other atmospheres could be supplied, such as inert gas, simulated engine exhaust, or blow-by gas.

The nub temperature is programmable. The maximum heating rate is 100° C./min; the maximum cooling rate is 50° C./min; and the operating range is from room temperature to 400° C. During initial construction, the nub surface temperature was measured by a thermocouple spot-welded to the nub face. The surface temperature was found to be less than the control thermocouple temperature. Typically, with the control thermocouple temperature at 300° C., the surface temperature is 270° C. Except in the film boiling regime described below, each drop impact, which occurs about once every 3 seconds, temporarily decreases the surface temperature an additional 20° C. until the drop has completely vaporized. Temperatures mentioned in this paper are the control thermocouple temperature, not surface temperature.

Gasoline is delivered to the nub face through a hypodermic needle attached to a syringe pump. The flow rates are usually constant during a test, between 1.5 mL/h and 40 mL/h. (If desired, by wiring the syringe pump power through the alarm relays on the temperature controller, the fuel delivery can be stopped at nub temperatures greater than the high-alarm temperature setting or less than the low-alarm temperature setting.) The fuel supply needle is usually pressed into contact with the center of the nub face. For low flow rates (about 1.5 mL/h) or when making deposits from heavier liquids such as lubricants or diesel fuel, the needle is raised about 1 mm above the surface allowing drops to fall freely onto the nub face. Raising the needle prevents deposit from accumulating on the needle tip.

Special procedures were necessary for weighing the STRIDE deposit. The amount of STRIDE deposit is typically less than one milligram. Therefore, the nubs are weighed on a five-place balance (0.00001 g displayed resolution). To improve the repeatability of the determination of the deposit mass the nub is weighed five consecutive times before and five consecutive times after each STRIDE test. The five nub weights are then averaged to get a final nub weight. The procedure for weighing nubs is further complicated because the unloaded balance seldom returns to exactly zero tare after each weighing. So, the residual tare (usually within ±0.05 mg of zero) is subtracted from the indicated nub weight after each of the five weighings. This procedure of subtracting the residual tare after each weighing decreases the variance and was recommended by the balance manufacturer. For the above procedure, ninety-four weighings of the same unused nub over a period of a year gave a standard deviation of 0.029 mg, in good agreement with the advertised standard deviation of 0.03 mg.

The invention is further illustrated by the following non-limiting examples and comparison.

EXAMPLE 1

In the preferred STRIDE test, gasoline is delivered at a rate of 10 mL/hour to a 0.3 $cm^2$ stainless steel nub surface (e.g., a STRIDE nub). The surface temperature is cycled from 150 to 300° C. over 8 minutes. The test length is 4 hours. Additives that reduce IVD in IC engines give low levels of STRIDE deposits relative to base fuel. The results in Tables 2 and 4 are reported on a relative basis as % reduction (−) or increase (+) over the base fuel deposits. Table 2 shows that compounds $B(_1)$ to $B(_{10})$ reduce the level of STRIDE deposits. Table 2 and 4 shows that compound D (PIBA), and compounds C & D (PIBA+PE) substantially lower the level of STRIDE deposits.

The STRIDE test compared to an engine test is shown in FIG. 1. The STRIDE procedure successfully emulates IVD from a Honda ES6500 generator set. The Honda generator's engine is a two cylinder carbureted gasoline engine of 360 mL displacement. For non-additized base gasolines and base gasolines containing commercial additive packages (A) and (B), IVD was measured after operating the generator at 2.4 kW and 3000 rev/min for 20 h. FIG. 1 shows the percentage below base gasoline's STRIDE deposit for commercial additive packages (A) and (B) together with the percentage below the base gasoline's IVD from the Honda generator. Both commercial additive package (A) and (B) significantly reduce the level of deposits below base fuel levels in both the STRIDE and Honda Generator Engine Test.

TABLE 2

| Gasoline Additive | Concentration in the Gasoline (ppmw) | STRIDE Deposits % of Base Gasoline |
|---|---|---|
| Cmpd. D (PIBA) | 500 | (−) 94 |
| Cmpd. C & D (PE + PIBA) | 500 | (−) 62 |
| Cmpd. $B_{(1)}$ | 500 | (−) 34 |
| Cmpd. $B_{(2)}$ | 500 | (−) 20 |
| Cmpd. $B_{(3)}$ | 500 | (−) 12 |
| Cmpd. $B_{(4)}$ | 500 | (−) 12 |
| Cmpd. $B_{(5)}$ | 500 | (−) 48 |
| Cmpd. $B_{(6)}$ | 500 | (−) 12 |
| Cmpd. $B_{(7)}$ | 500 | (−) 10 |
| Cmpd. $B_{(8)}$ | 500 | (−) 44 |
| Cmpd. $B_{(9)}$ | 500 | (−) 30 |
| Cmpd. $B_{(10)}$ | 500 | (−) 38 |

EXAMPLE 2

In another example, BLA lowers base deposits levels associated with CCD. Additives were tested for their propensity to produce CCD or lower base gasoline CCD levels using the TORID-ASD (Additive Severity Diagram) bench test. The generic CCD bench test apparatus (called TORID)

has been partially disclosed in U.S. patent application Ser. No. 021,478, filed Feb. 10, 1998, which is incorporated by reference.

The TORID-ASD test involves placing several mg of a sample onto a sample holder surface. The sample is prepared from a mixture of the candidate additive and CCD precursors (toluene soluble CCD from a 1993 TRC fleet test). The sample is held at constant temperature for one hour while it is exposed to a pulsing hexane flame. The concentration of base gasoline CCD precursors and surface temperatures are chosen to be close to those that exist on the walls of a combustion chamber. 2 mg of the additive is combined with 2 mg of soluble CCD deposit precursors. The CCD precursors are the toluene soluble fraction of homogenized CCD collected from a ten car fleet test for CCD (SAE Paper #972836). The 4 mg mixture of additive and CCD precursor is placed on a stainless steel nub surface and held at a constant temperature for one hour while hexane is delivered into a surrounding chamber and ignited with a glow coil every 0.5 sec to simulate the combustion chamber flame. The weight of the deposit formed on the nub surface reflects the deposit forming tendency. TORID-ASD results at 300° C. are associated with deposit forming tendency at higher mileage.

Table 3 contains the TORID-ASD performance on the base CCD deposit precursors. At 300° C. compound D (PIBA) and mixture C&D (PE & PIBA) increase the level of deposits. At 300° C. compounds $B_{(1)}$, $B_{(2)}$, $B_{(5)}$, $B_{(6)}$, $B_{(7)}$, $B_{(8)}$, $B_{(9)}$, and $B_{(10)}$ lower the level of deposits.

TABLE 3

| Gasoline Additive | TORID-ASD Deposit mg at 300° C. |
|---|---|
| 2 mg Base | 0.57 |
| 2 mg Base + 2 mg Cmpd. D (PIBA) | 1.03 |
| 2 mg Base + 2 mg Cmpd. C & D (PIBA + PE) | 0.61 |
| 2 mg Base + 2 mg Cmpd. $B_{(1)}$ | 0.56 |
| 2 mg Base + 2 mg Cmpd. $B_{(2)}$ | 0.56 |
| 2 mg Base + 2 mg Cmpd. $B_{(3)}$ | 0.60 |
| 2 mg Base + 2 mg Cmpd. $B_{(4)}$ | 0.57 |
| 2 mg Base + 2 mg Cmpd. $B_{(5)}$ | 0.54 |
| 2 mg Base + 2 mg Cmpd. $B_{(6)}$ | 0.45 |
| 2 mg Base + 2 mg Cmpd. $B_{(7)}$ | 0.54 |
| 2 mg Base + 2 mg Cmpd. $B_{(8)}$ | 0.51 |
| 2 mg Base + 2 mg Cmpd. $B_{(9)}$ | 0.55 |
| 2 mg Base + 2 mg Cmpd. $B_{(10)}$ | 0.44 |

Figure 2:
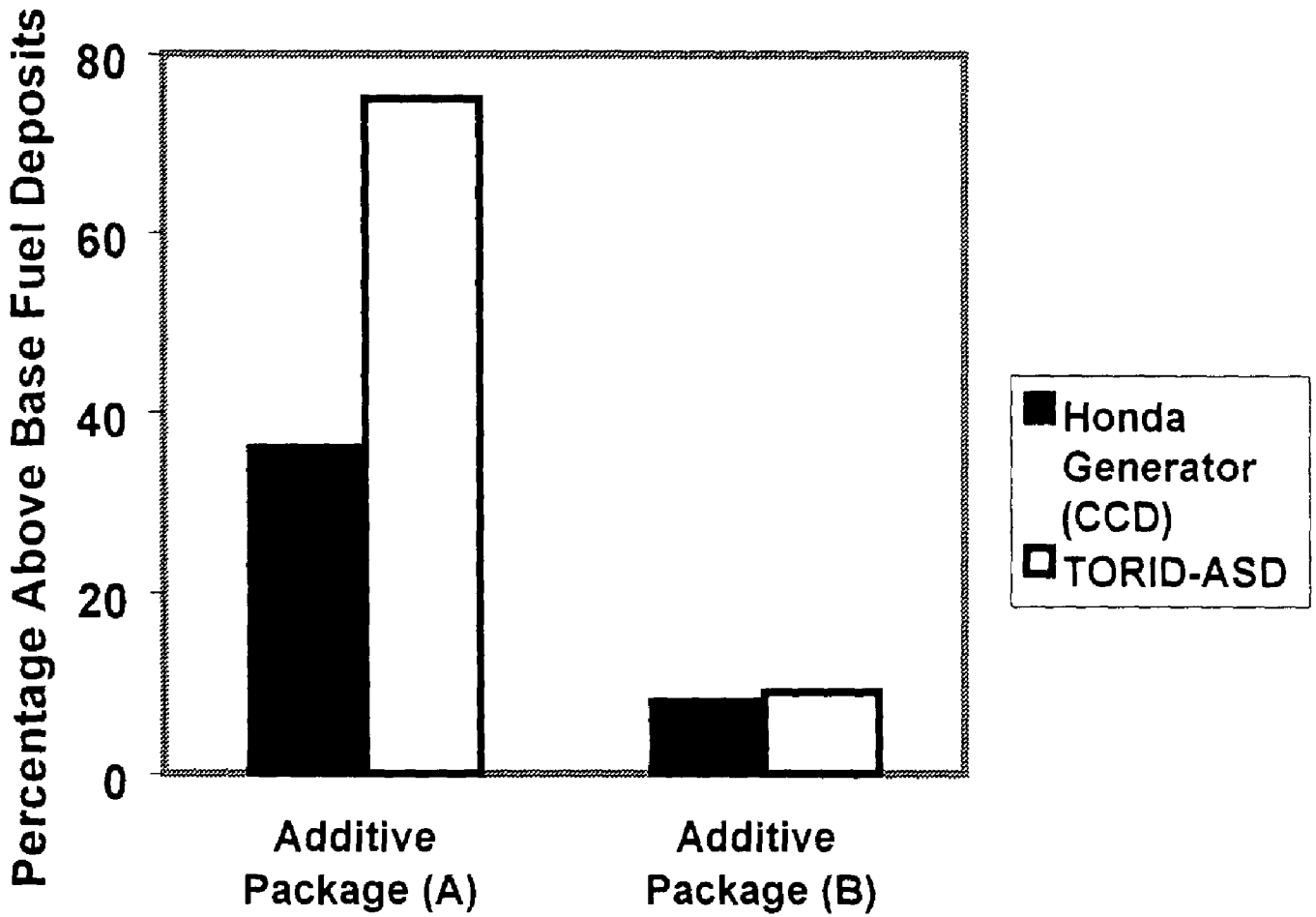
FIG. 2 presents a comparison of the results secured using the TORID-ASD test and the results from an engine test using gasolines containing 2 different commercial additive packages (A) and (B). The TORID-ASD procedure successfully emulates CCD results from a Honda ES 6500 generator test.

The TORID-ASD test compared to an engine test is shown in FIG. 2. Commercial additive packages (A) and (B) were tested at 300° C. in TORID-ASD and referenced to the deposits produced from 2 mg. of soluble CCD deposit precursors from base gasoline. The TORID-ASD procedure successfully emulates CCD from a Honda ES6500 generator set. The Honda generator's engine is a two cylinder carbureted gasoline engine of 360 mL displacement. For non-additized base gasolines and base gasolines containing commercial additive packages (A) and (B), CCD was measured after operating the generator at 2.4 kW and 3000 rev/min for 20 h. FIG. 2 shows the percentage above base gasoline's CCD for commercial additive packages (A) and (B). Commercial additive package (A) significantly increases the level of deposits over base fuel levels in both the TORID-ASD and Honda Generator Engine Tests. Commercial additive package (B) resulted in only slightly elevated level of deposits over base fuel levels in both the TORID-ASD and Honda Generator Engine Tests.

EXAMPLE 3

Table 4 shows that compound D (PIBA), and mixture C & D (PE+PIBA) substantially lower the level of STRIDE deposits. Table 4 shows that BLA+PIBA, all BLA+PIBA+PE mixtures, and mixtures of C & F and C& K listed substantially lower the level of STRIDE deposits.

TABLE 4

| Gasoline Additive | Concentration in the Fuel (ppmw) | STRIDE Deposits % of Base Fuel |
|---|---|---|
| Cmpd. D (PIBA) | 500 | (−) 94 |
| Cmpd. C & D (PE + PIBA) | 500 | (−) 62 |
| Cmpd. C (PE) | 500 | (−) 25 |
| Cmpd. $B_{(4)}$ & C & D | 500 | (−) 30 |
| Cmpd. $B_{(4)}$ & C & D | 1000 | (−) 44 |
| Cmpd. $B_{(5)}$ & C & D | 500 | (−) 82 |
| Cmpd. $B_{(5)}$ & C & D | 1000 | (−) 76 |
| Cmpd. $B_{(11)}$ & C & D | 500 | (−) 74 |
| Cmpd. $B_{(11)}$ & C & D | 1000 | (−) 72 |
| Cmpd. $B_{(9)}$ & C & D | 1000 | (−) 78 |
| Cmpd. $B_{(9)}$ & D | 1000 | (−) 72 |
| Cmpd. $B_{(4)}$ & D | 1000 | (−) 60 |
| Cmpd. $B_{(5)}$ & D | 1000 | (−) 56 |
| Cmpd. $B_{(6)}$ & D | 1000 | (−) 38 |
| Cmpd. C & F | 1000 | (−) 56 |
| Cmpd. C & K | 1000 | (−) 38 |

EXAMPLE 4

In another example, mixtures of BLA with PIBA and PIBA+PE lower deposits levels associated with CCD relative to PIBA alone. Table 5 contains the TORID-ASD performance on the base CCD deposit precursors and mixtures of BLA with PIBA and mixtures of BLA with PIBA and PE. For reference, Table 5 also shows the performance of PIBA and PE. Below base deposit levels are found at 300° C. for BLA+PIBA+PE additives Cmpd. $B_{(4)}$&C&D, Cmpd. $B_{(5)}$&C&D, and Cmpd. $B_{(11)}$&C&D and BLA+PIBA additive Cmpd $B_{(6)}$&D. Above base deposit levels are found for Cmpd. D (PIBA). While the mixtures Cmpd. $B_{(4)}$&D and Cmpd. $B_{(6)}$&D (DLD+PIBA) are above base at 300° C. there is substantially less deposits than would be expected based on their individual behavior. The synergistic relationship of mixtures is shown in Table 6.

TABLE 5

| Gasoline Additive | TORID-ASD Deposit mg at 300° C. |
|---|---|
| 2 mg Base | 0.57 |
| 2 mg Base + 2 mg Cmpd. D (PIBA) | 1.03 |
| 2 mg Base + 2 mg Cmpd. C & D (PE + PIBA) | 0.61 |
| 2 mg Base + 2 mg Cmpd. C (PE) | 0.48 |
| 2 mg Base + 2 mg Cmpd. $B_{(4)}$ & C & D | 0.53 |
| 2 mg Base + 2 mg Cmpd. $B_{(5)}$ & C & D | 0.52 |
| 2 mg Base + 2 mg Cmpd. $B_{(11)}$ & C & D | 0.62 |
| 2 mg Base + 2 mg Cmpd. $B_{(9)}$ & C & D | 0.60 |
| 2 mg Base + 2 mg Cmpd. $B_{(9)}$ & D | 0.86 |
| 2 mg Base + 2 mg Cmpd. $B_{(4)}$ & D | 0.64 |
| 2 mg Base + 2 mg Cmpd. $B_{(5)}$ & D | 0.90 |
| 2 mg Base + 2 mg Cmpd. $B_{(6)}$ & D | 0.52 |

TABLE 6

| Gasoline Additive | Observed TORID-ASD Deposit mg at 300° C. | Predicted TORID-ASD Deposit mg at 300° C. |
|---|---|---|
| 2 mg Base + 2 mg Cmpd. $B_{(4)}$ & D | 0.64 | 0.80 |
| 2 mg Base + 2 mg Cmpd. $B_{(6)}$ & D | 0.52 | 0.79 |

EXAMPLE 5

In another example, mixtures of BLA compound B with compounds A, C, and/or K lower base deposits levels associated with CCD. Additives are tested for their propensity to produce CCD or lower base gasoline CCD levels using the TORID-ASD (Additive Severity Diagram) bench test as in Example 2. TORID-ASD results at 300° C. are associated with deposit forming tendency at higher mileage. Mixtures of compound B with compounds C, F, I, or K are also tested with and without compound D (PIBA).

EXAMPLE 6

In another example, mixtures of BLD compounds A, G, and I with compounds G, H, and/or J lower base deposits levels associated with CCD. Additives are tested for their propensity to produce CCD or lower base gasoline CCD levels using the TORID-ASD (Additive Severity Diagram) bench test as in Example 2. TORID-ASD results at 300° C. are associated with deposit forming tendency at higher mileage. Mixtures of compound B with compounds C, F, I, or K are also tested with and without compound D (PIBA).

EXAMPLE 7

In another example, mixtures of compounds C through K lower base deposits levels associated with CCD. Additives are tested for their propensity to produce CCD or lower base gasoline CCD levels using the TORID-ASD (Additive Severity Diagram) bench test as in Example 2. TORID-ASD results at 300° C. are associated with deposit forming tendency at higher mileage. Compound C, E, F, G, H, I and K individually and in mixtures with each other are also tested with and without compound D (PIBA).

What is claimed is:

1. An unleaded gasoline for reducing at least one of combustion chamber deposits and intake valve deposits, comprising:

a major amount of an unleaded gasoline base fuel; and an effective amount to reduce at least one of combustion chamber deposits and intake valve deposits of an additive having a formula selected from the group consisting of:

(E)

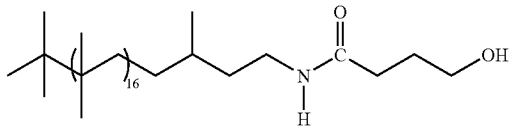

(G)

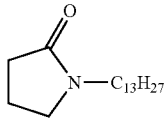

(H)

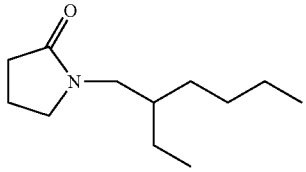

and mixtures thereof.

2. The gasoline according to claim 1, wherein the additive is a mixture of at least one member selected from the group consisting of (E), (G), and (H) and at least additional one member selected from the group consisting of (A)

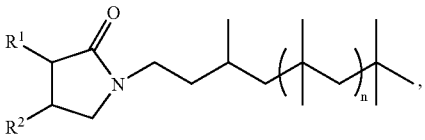

(B)

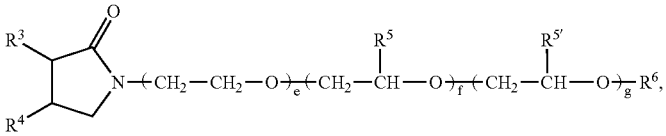

(C)

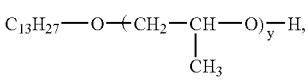

(D)

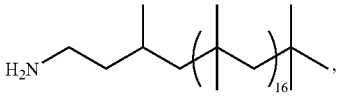

-continued (F)

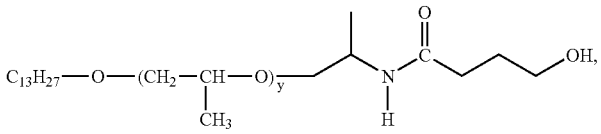

(I)

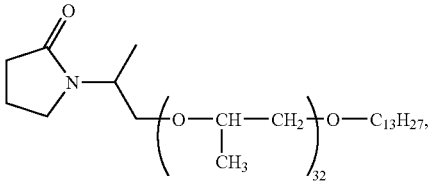

(J)

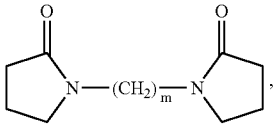

and (K)

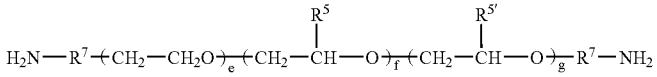

wherein n is an integer from 9 to 35 inclusive;

m is an integer from 2 to 6 inclusive;

$R^5$ and $R^{5'}$ in formula (B) and (K) are independently selected from the group consisting of H, $CH_2$, and $CH_2CH_3$;

$R^6$ is H or $C_1$–$C_{20}$ alkyl;

$R^1$, $R^2$, $R^3$, and $R^4$ are independently selected from the group consisting of H, and $C_1$–$C_{100}$ alkyl, or taken together with the two carbons between $R^1$ and $R^2$, or between $R^3$ and $R^4$ form an aliphatic ring of 5–8 carbon atoms; e, f and g independently are an integer from 0 to 50 inclusive wherein at least one of e, f and g is not 0; $R^7$ is $C_1$–$C_{25}$ alkyl or cycloalkyl, and y is an integer from 1–50 inclusive.

3. The gasoline according to claim 2, wherein when the additional additive is (A), n is an integer from 9 to 20 inclusive.

4. The gasoline according to claim 3, wherein n is 16, and $R^1$ and $R^3$ are H.

5. The gasoline according to claim 2, wherein the additive is a mixture of at least one member selected from the group consisting of (E), (G), (H), and further containing (A).

6. The gasoline according to claim 5, wherein the additive further comprises (D).

7. The gasoline of claim 1, wherein the additive makes up 0.0005–0.5 wt % of the gasoline base fuel.

8. An unleaded gasoline for reducing at least one of combustion chamber deposits and intake valve deposits, comprising:

a major amount of an unleaded gasoline base fuel; and an effective amount to reduce at least one of combustion chamber deposits and intake valve deposits of an additive comprising a mixture of

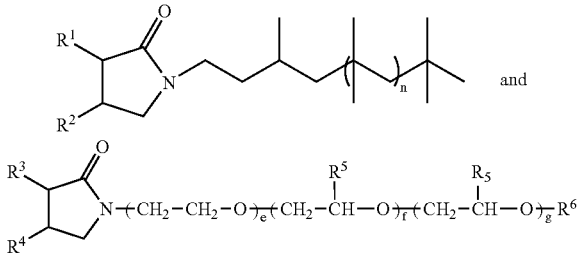

and wherein:

n is an integer from 9 to 35 inclusive;

e, f and g independently are an integer from 0 to 50 inclusive, wherein at least one of e, f and g is not 0;

$R^1$, $R^2$, $R^3$ and $R^4$ are independently selected from the group consisting of H, and $C_1$–$C_{100}$ alkyl or taken together with the two carbons between $R^1$ and $R^2$ or between $R^3$ and $R^4$ form an aliphatic ring of 5–8 carbon atoms;

$R^5$ and $R^{5'}$ are independently selected from the group consisting of H, $CH_3$ and $CH_2CH_3$, and $R^6$ is H or $C_1$–$C_{20}$ alkyl.

9. An unleaded gasoline for reducing at least one of combustion chamber deposits and intake valve deposits, comprising a major amount of an unleaded gasoline base fuel, and an effective amount to reduce at least one of combustion chamber deposits and intake valve deposits of an additive comprising a mixture of at least one of

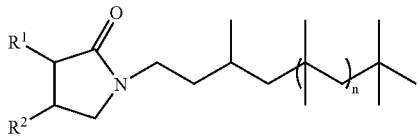

and

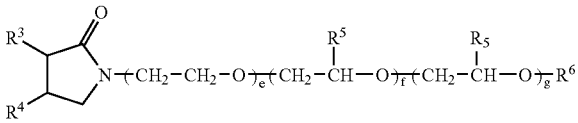

in combination with at least one additional component selected from

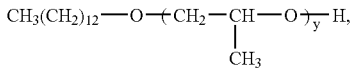

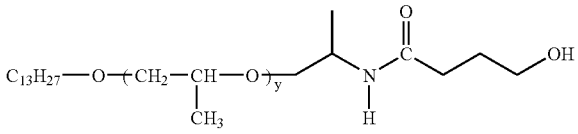

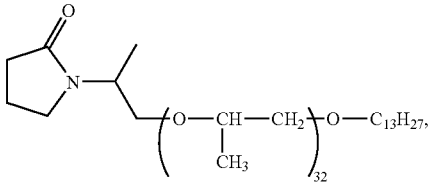

-continued

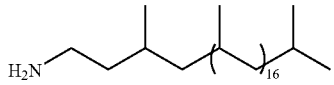

, or

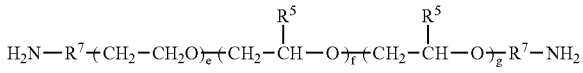

wherein:

n is an integer from 9 to 35 inclusive;

e, f and g independently are an integer from 0 to 50 inclusive, wherein at least one of e, f and g is not 0;

$R^1$, $R^2$, $R^3$ and $R^4$ are independently selected from the group consisting of H and $C_1$–$C_{100}$ alkyl or taken together with the two carbons between $R^1$ and $R^3$ or between $R^3$ and $R^4$ form an aliphatic ring of 5–8 carbon atoms;

$R^5$ and $R^{5'}$ are independently selected from the group consisting of H, $CH_3$ and $CH_2CH_3$, y is an integer from 1 to 50 inclusive, $R^7$ is $C_1$–$C_{25}$ alkyl or cycloalkyl, and $R^6$ is H or $C_1$–$C_{20}$ alkyl.

10. A method for reducing combustion chamber deposits, intake valve deposits or both that form in an internal combustion engine run on unleaded gasoline, comprising combusting in said engine the gasoline of claim 1, 2, 5, 6, 8 or 9.

11. A method of forming the gasoline of claim 1, 2, 5, 6, 8 or 9 to reduce combustion chamber deposits, intake valve deposits or both by mixing the unleaded gasoline base fuel with each additive, in the range of 0.0005–0.5 wt % of the unleaded gasoline base fuel.

* * * * *